US008267747B2

(12) United States Patent
Anderson

(10) Patent No.: US 8,267,747 B2
(45) Date of Patent: Sep. 18, 2012

(54) SURFACE ABRASION OF OBJECTS

(75) Inventor: Alec Anderson, Solihull (GB)

(73) Assignee: Koolmill Systems, Ltd., Solihull (GB)

( * ) Notice: Subject to any disclaimer, the term of this patent is extended or adjusted under 35 U.S.C. 154(b) by 634 days.

(21) Appl. No.: 12/311,669

(22) PCT Filed: Oct. 9, 2007

(86) PCT No.: PCT/GB2007/003844

§ 371 (c)(1),
(2), (4) Date: Apr. 8, 2009

(87) PCT Pub. No.: WO2008/044014

PCT Pub. Date: Apr. 17, 2008

(65) Prior Publication Data

US 2010/0015899 A1 Jan. 21, 2010

(30) Foreign Application Priority Data

Oct. 10, 2006 (GB) ..... 0620037.2

(51) Int. Cl.
*B24B 31/00* (2006.01)

(52) U.S. Cl. ..... 451/326; 451/327

(58) Field of Classification Search ..... 451/326, 451/327

See application file for complete search history.

(56) References Cited

U.S. PATENT DOCUMENTS 5,240,115 A * 8/1993 Crossley et al. ..... 209/732

FOREIGN PATENT DOCUMENTS

| | | | |
|---|---|---|---|
| DE | 269 085 | C | 11/1912 |
| EP | 0 755 304 | B1 | 9/2001 |
| FR | 1 489 811 | A | 7/1967 |
| GB | 197 990 | A | 5/1923 |

OTHER PUBLICATIONS

International Search Report from PCT Application No. PCT/GB2007/003844.

* cited by examiner

*Primary Examiner* — Maurina Rachuba

(74) *Attorney, Agent, or Firm* — E. Victor Indiano; Indiano Law Group, LLC

(57) ABSTRACT

A chamber for an abrading apparatus comprising an inlet, an outlet, a main body and an insert, the main body comprising a recess on an inner surface thereof between the inlet and the outlet, whereby, in use, the insert is removably retained in the recess. The apparatus also comprises a housing and actuation means, the chamber being pivotably secured at one end to the housing by a quick release pin, wherein the actuation means is connected to the chamber and operable to cause the chamber to pivot with respect to the housing toward and/or away from the abrasive surface.

14 Claims, 3 Drawing Sheets

SURFACE ABRASION OF OBJECTS

This invention relates generally to an apparatus for surface treatment of objects. More specifically, but not exclusively, the invention relates to apparatus for surface abrasion of small objects, for example seeds, including cereals, legumes, nuts and the like; cleaning aggregate and objects of wood, plastics, mineral or metal. In particular, the invention relates to treatment chambers for such apparatus.

Various apparatus for surface abrasive treatment of small objects are already known. Typical apparatus comprise, in combination, a constant depth chamber, means for providing an abrasive moving bottom which passes under a transverse wall of the chamber, an inlet for objects to be abraded, and an outlet for abraded objects. The apparatus are generally arranged such that, in use, objects circulate in the chamber and material removed from the objects passes under the transverse wall. The chamber has a top, opposed to the bottom, the top being sufficiently close to the bottom that, in use, pressure is exerted on the circulating objects to press the lowermost objects against the bottom.

Some apparatus include an endless belt having an abrasive surface which moves over a generally flat plate to provide the abrasive moving bottom. Further apparatus include a rotating drum having an endless abrasive outer surface to provide the moving bottom of the chamber.

EP 0755304 proposes an apparatus in which small objects are milled in a machine comprising a rotating vertical drum having an endless abrasive belt attached to the outer surface of the drum. Chambers having a substantially rectangular cross-section are spaced about the drum so that the belt acts as a floor to the chambers with a slight gap between each chamber and the belt. The objects are passed vertically downwards by gravity and abraded by the belt. Surface material removed from the objects passes through the gap directed through a subsidiary outlet alongside the main outlet of each chamber while the objects pass through a primary outlet at the base of the chamber.

It is a non-exclusive object of the invention to provide an improved apparatus for abrading objects. It is a further non-exclusive object of the invention to provide an improved chamber for such apparatus.

It has been observed that the diameter of the main outlet in the aforementioned apparatus, particularly of the apparatus disclosed in EP 0755304, may be used as a first control over the extent of removal of the surface material. In particular, the diameter of the outlet controls the flow of objects which may pass through the outlet, thus inducing a level of resistance or back pressure. This back pressure directly affects the extent of removal of the surface material. It will be appreciated that different types of small objects will require different levels of back pressure.

It is therefore a non-exclusive object of the present invention to provide a chamber which facilitates adjustment of the outlet configuration.

In all of the aforementioned apparatus, an optimal spacing must be determined between the chamber and the abrasive moving bottom. In particular, a balance must be struck between preventing the small objects from escaping from the chamber during the abrasion process and minimising the wear on components of the chamber which are in contact with, or in close proximity to, the abrasive moving bottom.

In the case of the apparatus described in EP 0755304, it has been observed that a buildup of abraded material accumulates on the backing of the belt causes its thickness to increase.

Over time this causes the belt to contact the wear components resulting in leakage and reduced service life for these components and the abrasive belt.

It is a further non-exclusive object of the invention to provide a chamber which mitigates this issue.

In one aspect, the invention provides a chamber for an abrading apparatus comprising an inlet, an outlet, a main body and an insert, the main body comprising a recess on an inner surface thereof between the inlet and the outlet, whereby, in use, the insert is removably retained in the recess.

The recess may be adjacent the inlet or the outlet. Preferably, the recess is adjacent the outlet. The insert may comprise an aperture therein. The aperture may be substantially aligned with the outlet and/or provide the outlet when the insert is in the recess. Preferably, the insert comprises a generally flat plate. More preferably, the insert is easily insertable into and removable from said recess.

The main body preferably comprises an elongate member having a substantially channel shaped cross-section. More preferably, the recess is formed on an inner surface of the main body.

The insert may be retained in the recess, in use, by a movable abrasive surface of the abrading apparatus. Preferably, in use, the abrasive surface defines at least part of a wall of the chamber. More preferably, the insert further comprises a wear surface adjacent to and facing said abrasive surface.

Alternatively, the insert may be retained in the recess by a securing means, for example a removable pin, a threaded bolt, or spring loaded ball detent arrangement.

In a second aspect, the invention provides an apparatus for abrading the surface of objects, said apparatus comprising at least one of said chambers and a movable abrasive surface defining a wall of said at least one chamber.

In a further aspect, the invention provides an apparatus for abrading the surface of objects comprising a housing, a chamber and an abrasive surface defining a wall of the chamber, the chamber being pivotably secured at one end to the housing by a removable pin.

In a yet further aspect, the invention provides an apparatus for abrading the surface of objects comprising a housing, actuation means, a chamber and an abrasive surface defining a wall of the chamber, the chamber being pivotably secured at one end to the housing, wherein the actuation means is connected to the chamber and operable to cause the chamber to pivot with respect to the housing toward and/or away from the abrasive surface.

The actuation means may comprise a pneumatic cylinder and may be connected to a lever member of the chamber.

The apparatus may comprise a rotatable drum, for example wherein the outer surface of said drum comprises the abrasive surface. The abrasive surface may be provided by, for example, an abrasive belt. Preferably, the apparatus comprises driving means for inducing rotation of the drum.

The drum may be vertically disposed. The at least one chamber may also be vertically disposed. Preferably, the at least one chamber is orientated such that the outlet is lowermost, whereby, in use, small objects introduced through the inlet fall through the chamber under the force of gravity. Alternatively or additionally, a vacuum may be provided at the outlet.

One embodiment of the invention will now be described, by way of example only, with reference to the accompanying drawings, in which.

Figure 1:
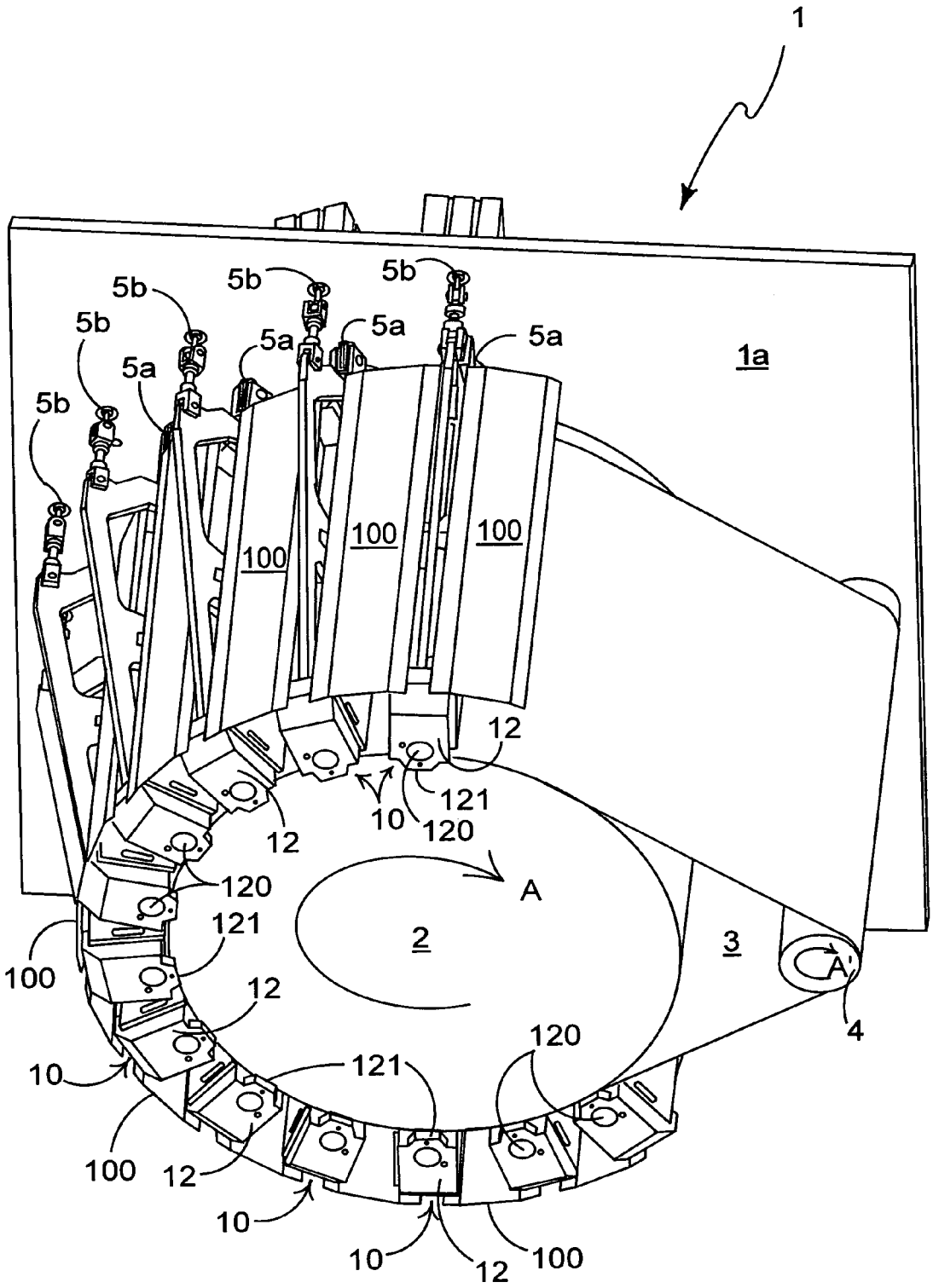
FIG. 1 is a perspective view of part of an apparatus according to the invention.

As shown in FIG. 1, the apparatus comprises a housing 1, only part of which is shown, a drum 2, an abrasive belt 3, a tension and tracking roller 4 and twelve treatment chambers 10.

The housing 1 is a substantially cubical shell with a supported top cover 1*a*. The top cover 1*a* includes a plurality inlet holes (not shown), chamber clevis mounts 5*a* and lever clevis mounts 5*b*.

The drum 2 is cylindrical in shape and rotatable about its main axis. The roller 4 is also cylindrical in shape with a diameter substantially smaller than that of the drum 2. The roller 4 is freely rotatable about its main axis. The drum 2 is connected to a drive motor (not shown) which induces rotation thereof. In direction A. The belt 3 is an endless loop having a width substantially the same as the height of the drum 2 and includes a coating of sand or grit on a backing of cloth, paper or plastics, the particles being held in place by a resin or like bond.

The drum 2 is rotatably mounted to the housing 1 by bearings (not shown) and extends substantially perpendicularly from the top cover 1*a*. The roller 4 is also mounted to the housing 1 by bearings (not shown) with its main axis offset from, but substantially parallel to, that of the drum 2. The belt 3 is mounted over the roller 4 and drum 2 with sufficient tension to ensure that rotation of the drum 2 induces rotation of the belt 3 which drives the roller 4 in direction A'.

Figure 2:
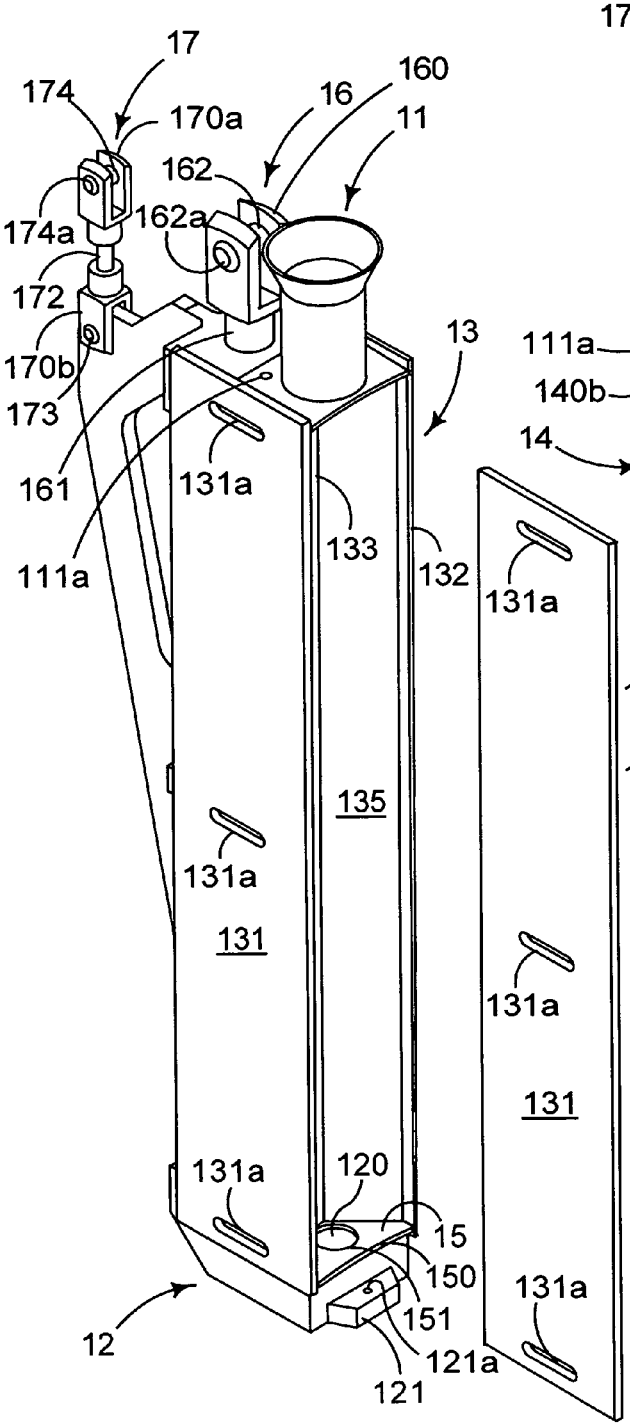
FIG. 2 is a perspective view of one of the chambers of the apparatus of FIG. 1.
Figure 3:
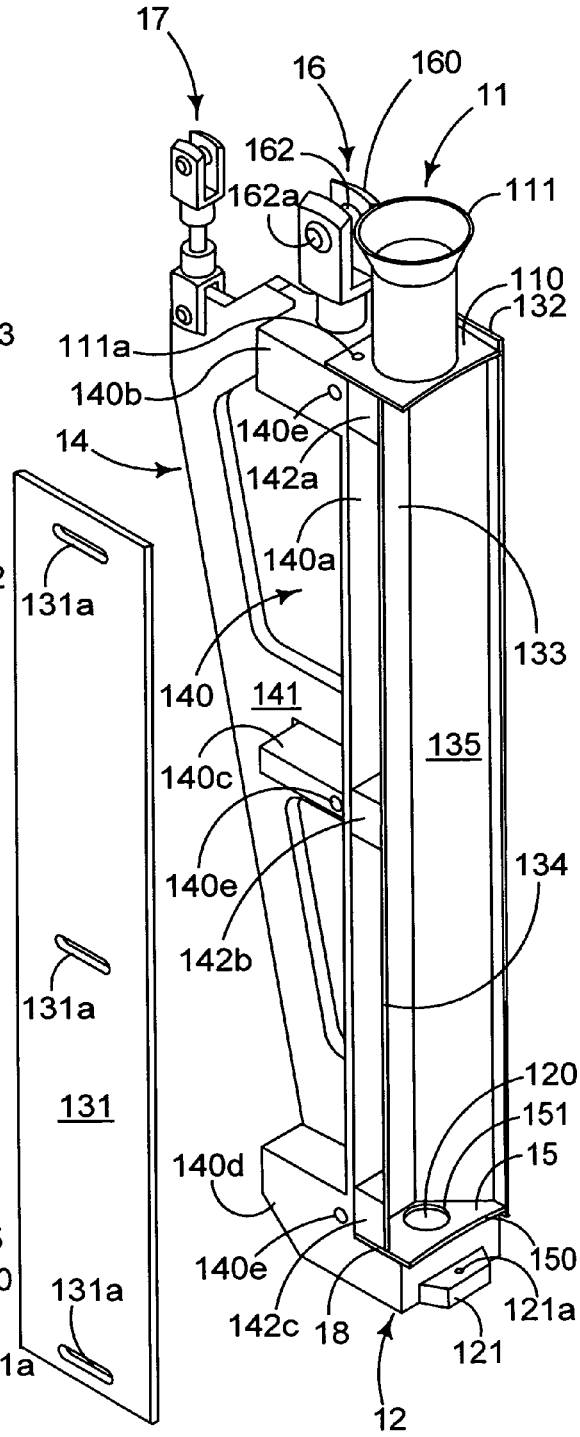
FIG. 3 is a perspective view of the chamber of FIG. 2 with one of the side walls removed.

Referring now to FIGS. 2 and 3, each chamber 10 includes an inlet 11, an outlet 12, a main body 13, a chamber frame 14, an insert 15, a chamber clevis 16 and a cylinder 17. The inlet 11 in this embodiment includes a hollow member 111 secured to a plate 110. The hollow member 111 includes a cylindrical portion and an inverted frustoconical portion connected to the top of the cylindrical portion. The plate 110 includes an inlet hole (not shown) and two mounting holes 111*a* (only one of which is shown) through its thickness. The hollow member 111 may either be secured to the plate 110, for example, by welding, or other suitable means, such that the cylindrical portion is aligned with the inlet hole (not shown) or incorporated within the end of feed pipes (not shown).

The outlet 12 includes an outlet hole 120 through its thickness and an registration flange 121. The outlet 12 is substantially cuboid in shape, integrally formed with the chamber frame 14 and extends from the bottom thereof. The registration flange 121 is substantially trapezoidal in shape and includes a securing hole 121*a* therethrough.

The main body 13 forms an elongate channel section having a substantially U-shaped cross-section. The main body 13 includes first and second side walls 131 and 132, an external wall 133 and two angled walls 134 and 135. The first and second side walls 131, 132 include mounting slots 131*a*, 132*a* (132*a* not shown). The external wall 133 is integrally formed with the two angled walls 134 and 135 using a single sheet of material, for example sheet metal.

The chamber frame 14 includes a support member 140, a lever member 141 and three chamber support blocks 142*a*, 142*b*, 142*c*. The support member 140 includes a plate portion 140*a* having an upper support block 140*b*, a lower support block 140*c* and a reinforcement rib 140*d* extending from a first side thereof. The support member 140 also includes threaded side wall mounting holes 140*e*. The lever member 141 is integrally formed with the upper support block 140*b*, the lower support block 140*c* and the reinforcement rib 140*d*. In this embodiment, the three support blocks 142*a*, 142*b*, 142*c* are secured to the plate portion 140*a* on the opposite side thereof to the lever member 141. A first support block 142*a* is positioned adjacent the top end of the chamber frame 14. A second support block 142*b* is positioned substantially at the centre of the chamber frame 14. A third support block 142*c* is positioned adjacent the bottom end of the chamber frame 14, offset from the integral outlet 12 to provide a recess 18 therebetween.

The insert 15 is a substantially flat plate which is substantially square in plan with one curved or arcuate edge 150 and a hole 151 through its thickness. The thickness of the insert is slightly less than that of the aforementioned recess 18 between the third support block 142*c* and the outlet 12. The insert 15 is made of plastics material in this embodiment for ease of manufacture.

The chamber clevis 16 includes a substantially 'U'-shaped portion 160 integrally formed with a cylindrical portion 161 at the base of the 'U'. Each of the opposing walls of the 'U'-shaped portion 160 includes a hole (not shown) through its thickness. The cylindrical portion 161 includes a threaded portion (not shown) which engages with a threaded hole (not shown) in the chamber frame 14. A quick release pin 162 extends through the aforementioned holes (not shown) in the opposing walls of the 'U'-shaped portion 160. The pin 162 in this embodiment includes a head portion 162*a* at one end thereof and a snap ring (not shown) adjacent the other end thereof to retain the pin 162 in place.

The cylinder 17 includes two opposing substantially 'U'-shaped portions 170*a*, 170*b* interconnected by a pneumatic cylinder 172 which is controlled by a central control system (not shown), thereby to provide an assembly having an adjustable length. Each of the opposing walls of the 'U'-shaped portions 170*a*, 170*b* includes a hole (not shown) through its thickness. A quick release pin 173 extends through the holes (not shown) in the opposing side walls of the lower 'U'-shaped portion 170*b* and through a hole (not shown) in the lever member 141 of the chamber frame 14.

A quick release pin 174 is also provided which extends through the holes (not shown) in the opposing walls of the upper 'U'-shaped portion 170*a*. The quick release pin 174 in this embodiment includes a head portion 174*a* at one end thereof and a snap ring (not shown) adjacent the other end thereof to retain the pin 174 in place.

The inlet 11 may be secured to the top of the chamber frame 14 using bolts (not shown) which extend through the aforementioned mounting holes 111*a* in the inlet plate 110 and into corresponding threaded holes (not shown) in the chamber frame 14. The inlet 11 is orientated such that the hollow member extends upwardly from the chamber frame 14.

The integrally formed external wall 133 and angled walls 134 and 135 of the chamber main body 13 are secured to three support blocks 142*a*, 142*b*, 142*c* using bolts (not shown) or projections (not shown) on the outer surface which cooperate with recesses (not shown) in the support blocks 142*a*, 142*b*, 142*c*. The two side walls 131, 132 are mounted to the chamber frame using bolts (not shown) which pass through the slots 131*a*, 132*a* and into the threaded side wall mounting holes 140*e* of the chamber frame 14. The use of slots 131*a*, 132*a* provides a degree of adjustability in the position of each side wall 131, 132.

As stated above, the outlet 12 is integrally formed with the chamber frame 14 and extends therefrom. The outlet 12 is positioned at the bottom of the chamber frame 14 such that the outlet hole 120 is aligned with the channel section of the main body 13.

Each chamber 10 is secured to the housing 1 using the chamber clevis 16 and the cylinder 17. The chamber clevis 16 is secured to one of the chamber clevis mounts 5*a* of the top cover 1*a* using the quick release pin 162. The cylinder 17 is secured to one of the lever clevis mounts 5*b* of the top cover 1*a* using the quick release pin 174. The registration flange 121 registers in a cooperatingly shaped recess (not shown) in the base (not shown) of the housing 1 to ensure proper alignment of the chamber 10. Optionally, the registration flange 121 may be secured to a discharge chute (not shown) using a bolt (not shown) which passes through the hole 121*a* in the registration flange 121 and engages a threaded hole (not shown) in the discharge chute (not shown).

The chambers 10 are equidistantly spaced about the circumference of the drum 2 in the area thereof which is in contact with the belt 3. The chambers 10 extend generally parallel to the main axis of the drum 2. The open side of the channel section of the chambers 10 is adjacent to the belt 3 such that the belt 3 defines a wall of the chamber 10.

In this embodiment, the apparatus includes bridging plates 100 which extend between chambers 10 and are secured thereto, for example using bolts (not shown). The area between the bridging plates 100 and the belt 3 defines a discharge area for abraded material.

When the chambers 10 are in place, the two side walls 131, 132 of each chamber 10 are adjacent the belt 3. The first side wall 131 is adjusted to provide a gap using the adjustable slot arrangement discussed above, whilst the second side wall 132 is adjusted to provide minimal clearance with the belt.

The discharge area is open at the base of the apparatus to form a subsidiary outlet between the chambers 10. A loading hopper (not shown) is located above the apparatus and includes feed pipes (not shown) extending therefrom. Each feed pipe (not shown) is connected to the loading hopper, extends through an inlet hole (not shown) in the housing 1 and is connected to the inlet 11 of one of the chambers 10.

In use, the drive motor effects the rotation of drum 2 in direction A, while the objects to be abraded are loaded into the hopper (not shown) and fed via the feed pipes (not shown) to the inlet 11 of the chambers 10.

As the drum 2 rotates, it abrades the objects adjacent to its surface to remove a portion of the surface material. The objects pass from the inlet 11 to the outlet 12 of each chamber. The objects circulate within the chamber 10 under the action of the belt on the rotating drum 2 so that they contact the belt 3 repeatedly and an outer layer of the objects is removed. The removed material passes under the wall 131 through the gap and through the subsidiary outlet between the chambers 10. The abraded objects leave the chamber by passing through the hole 151 in the insert 15 and exit via the outlet hole 120 to the outlet chute (not shown). Objects are thus collected separately from the material removed and, for example, are passed into collection bags (not shown).

The effective diameter of the outlet 12 is of reduced size compared to the cross-section of the chamber 10, so as to restrict the flow of objects leaving the chamber 10. This provides a controllable back pressure in the chamber 10, which urges the object against the belt 3.

The diameter of the insert hole 151 is used in the apparatus to control the effective diameter of the outlet 12 and is therefore a first control over the extent of removal of the surface material. However, the local pressure within the chamber 10 will be dependent on inter alia the geometry of the chamber 10, the speed of travel of the belt 3 and its abrasiveness, and these parameters may be used as a second level of control.

The amount of pressure necessary to remove the required surface material from the objects is dependent on a number of factors, for example the size, shape and properties of the objects, depth and width of the treatment chamber 10, the speed at which the drum 2 rotates, the coarseness of the belt, and so on. As stated above, it is known to vary the geometry of the chambers in order to alter the treatment parameters, which may be required for different objects and/or different treatment requirements.

A further phenomenon which has been observed is that as abraded material builds up on the belt 3 adjacent the outlet 12, whereby the rate of wear of the belt facing surface of the chamber increases considerably. It has also been observed that the use of metallic materials provides relatively little improvement in wear characteristics over using plastics material. Consequently, it is preferable to use plastics material for fabricating the inserts 15 due to its inherent ease of manufacture.

The present invention provides a chamber design which allows for quick and easy replacement of the insert 15. Inserts may be colour coded based on the hole diameter, thereby reducing the likelihood of using an incorrect outlet configuration for a given product.

Figure 4:
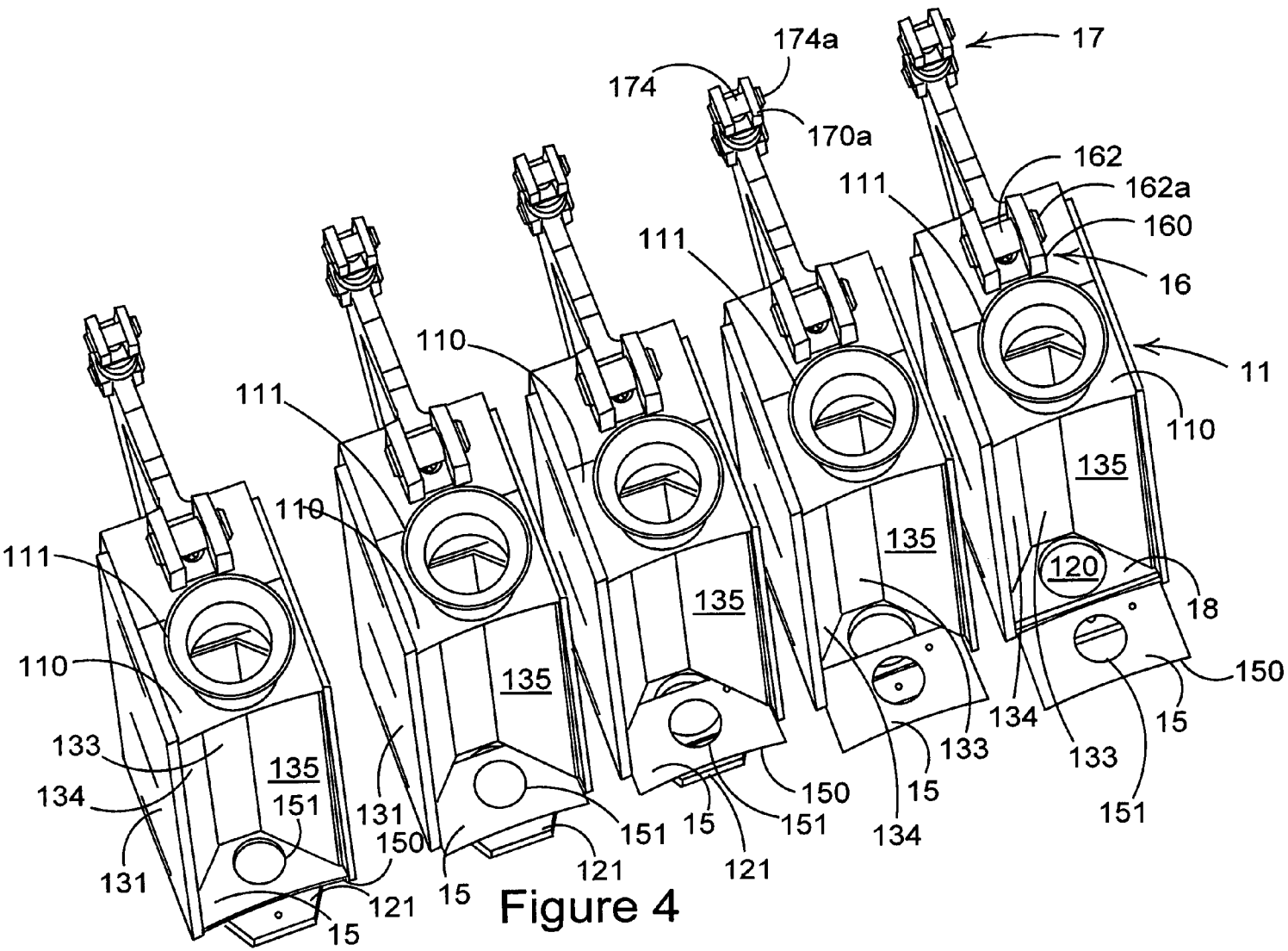
FIG. 4 shows an array of chambers of the type depicted in FIG. 2 sequentially illustrating insertion of a preferred insert.

In order to replace the insert 15, the pneumatic cylinder 172 is actuated to draw the lever member 141 toward the top cover 1*a* of the housing 1, thereby pivoting the chamber 10 away from the drum 2. This provides access to the insert 15, which is simply slid out of the recess 18 in the chamber 10 by an operator (not shown). A new insert 15, having a different diameter of hole 151 if desired, is then inserted into the recess 18 and the pneumatic cylinder 172 is actuated in the opposite direction to secure the chamber 10 back in position as shown in FIG. 4.

In one example, drum 2 is run to produce a surface speed of about 10 meters/sec. Rice grains, for example, are fed via the inlet 11 of each chamber 10. The grains are fed through the chamber 10 at a rate to generate pressure as described above and to urge the objects against the abrasive belt 3 of the drum 2 as the objects pass through the chambers 10. The material removed is preferably rice bran and/or husk and the abraded objects being whitened rice grains.

The invention is not limited to the embodiment shown. There may be a further insert 15 provided at the inlet 11 as well as or in place of the insert adjacent the outlet 12. The insert 15 may be of a different shape or material, for example steel or any other suitable material, and need not be in the form of a plate. The insert may be retained within the recess 18 by securing means, for example a removable pin, a threaded bolt, or spring loaded ball detent arrangement. The chamber outlet may be provided by the insert 15, for example rather than by a separate outlet 12.

The support blocks 142*a*, 142*b*, 142*c* may be integrally formed with the support member or alternatively, the entire chamber 10 may be integrally formed with the exception of the insert 15. The walls of the chamber may be flat or curved.

The apparatus may include means for adjusting the tension of the belt. The bridging plates 100 may be flexible or rigid or omitted altogether. The drum 2 may be replaced with a flat surface on which the belt translates, which flat surface may be substantially vertical or substantially horizontal. A vacuum may be drawn. The quick release pins may be replaced with any suitable removable pin.

An auger may be associated with each chamber 10 to supply the objects into the respective chamber 10, either from the top or the bottom. Pressure may be generated by use of the auger and that pressure is generated over a large area in the chamber thereby improving the efficiency of the apparatus. The apparatus may include means for further restricting the flow of abraded objects from the main outlet 12 in which case the pressure generated depends on a balance between the effect of the auger (e.g. its speed of rotation) and the degree of restriction of the outlet 12.

In the embodiment shown the chambers 10 are disposed in an arc of the drum 2, however, the chambers 10 may be arranged about the entire circumferential surface of the drum 2, for example where the belt 3 is secured to the outer surface of the drum 2. The apparatus may comprise a horizontal arrangement as described above.

The hollow member 111 may be removed altogether and the end of the feed pipe (not shown) may be arranged to register or align with or be received within the hole (not shown) in the plate 110, which wear plate 110 is preferably disposable.

Whilst the side wall 132 is adjusted to provide minimal clearance in this embodiment, this is not a critical factor in the milling process. The function of the side wall 132 is simply to prevent objects being abraded from escaping from the chamber 10.

The invention claimed is:

1. A chamber for an abrading apparatus, the chamber comprising an inlet, an outlet, a main body and an insert with an aperture through its thickness, the main body comprising an open side and a recess on an inner surface of the main body between the inlet and the outlet, the insert being removably retained in the recess with the aperture in communication with the outlet, wherein the open side of the main body is closed, in use, by a movable abrasive surface of the abrading apparatus.

2. A chamber as claimed in claim 1, wherein the insert is easily insertable into and removable from said recess by a quick release means.

3. A chamber as claimed in claim 1, wherein the recess is adjacent the outlet.

4. A chamber as claimed in claim 1, wherein the recess is adjacent the outlet, said aperture being substantially aligned with the outlet when the insert is in the recess.

5. A chamber as claimed in claim 1, wherein the insert comprises a generally flat plate that extends, in use, substantially perpendicularly relative to the movable abrasive surface of the abrading apparatus.

6. A chamber as claimed in claim 1, wherein the recess is formed on an inner surface of the main body.

7. A chamber as claimed in claim 1, wherein the main body comprises an elongate member having a substantially channel shaped cross-section.

8. A chamber as claimed in claim 1, wherein, in use, the abrasive surface defines at least a part of a wall of the chamber.

9. A chamber as claimed in claim 1, wherein the insert further comprises a wear surface adjacent to and facing the abrasive surface in use.

10. A chamber as claimed in claim 1, wherein the insert is retained in the recess by a securing means.

11. An apparatus for abrading the surface of objects, said apparatus comprising at least one chamber according to claim 1 and a movable abrasive surface defining a wall of said at least one chamber.

12. An apparatus as claimed in claim 11, wherein the apparatus comprises a rotatable drum the outer surface of which drum comprises the abrasive surface, wherein the at least one chamber is orientated such that the outlet is lowermost, whereby, in use, small objects introduced through the inlet fall through the chamber under the force of gravity.

13. An apparatus for abrading the surface of objects, said apparatus comprising at least one chamber and a movable abrasive surface defining a wall of the chamber, wherein the chamber includes an inlet, an outlet, a main body and an insert with an aperture through its thickness, the main body comprising a recess on an inner surface thereof between the inlet and the outlet, whereby, in use, the insert is removably retained in the recess such that the aperture is in communication with the outlet.

14. A chamber for an abrading apparatus, the chamber comprising an inlet, an outlet, a main body, a first insert with a first aperture through its thickness and a second insert with a second aperture through its thickness, the second aperture having a different size to the first aperture, the main body comprising a recess on an inner surface thereof between the inlet and the outlet, whereby, in use, one of the inserts is removably retained in the recess.

* * * * *